US006852025B2

(12) United States Patent
Gumucio Del Pozo

(10) Patent No.: US 6,852,025 B2
(45) Date of Patent: Feb. 8, 2005

(54) VERTICAL VENTILATOR FOR OUTDOORS AND/OR INDOORS

(76) Inventor: Pablo Gumucio Del Pozo, Ctra. Las Rozas - El Escorial km., 14,900 - 28260 Galapagar -Madrid (ES)

( * ) Notice: Subject to any disclaimer, the term of this patent is extended or adjusted under 35 U.S.C. 154(b) by 0 days.

(21) Appl. No.: 10/345,023

(22) Filed: Jan. 15, 2003

(65) Prior Publication Data

US 2003/0171093 A1 Sep. 11, 2003

(30) Foreign Application Priority Data

Mar. 11, 2002 (ES) ..... 200200572

(51) Int. Cl.[7] ..... F24F 7/007

(52) U.S. Cl. ..... 454/230; 416/171; 416/210 R; 454/306

(58) Field of Search ..... 454/230, 231, 454/233, 284, 292, 306; 415/80, 82; 416/90 R, 92, 155, 5, 171, 210, 244

(56) References Cited

U.S. PATENT DOCUMENTS

| | | | | | |
|---|---|---|---|---|---|
| 1,536,846 | A | * | 5/1925 | Heath et al. | 415/140 |
| 1,766,898 | A | * | 6/1930 | Grisham | 454/306 |
| 2,164,608 | A | * | 7/1939 | Cornelius | 454/228 |
| 2,835,186 | A | * | 5/1958 | Goldsmith | 454/306 |
| 4,184,415 | A | * | 1/1980 | Nicholson | 454/231 |
| 4,344,112 | A | * | 8/1982 | Brown | 362/96 |
| 4,653,705 | A | * | 3/1987 | Bensen | 244/17.11 |
| 5,273,402 | A | * | 12/1993 | Maury | 416/246 |
| 6,027,309 | A | * | 2/2000 | Rawls et al. | 416/5 |
| 6,692,231 | B1 | * | 2/2004 | Calvert | 416/153 |
| 2003/0133311 | A1 | * | 7/2003 | Robertson et al. | 362/555 |

FOREIGN PATENT DOCUMENTS

| | | | | |
|---|---|---|---|---|
| FR | 807553 | * | 1/1937 | 454/230 |
| GB | 509220 | * | 7/1939 | 454/233 |
| JP | 3-241240 | * | 10/1991 | 454/233 |
| JP | 5-306833 | * | 11/1993 | 454/231 |
| SU | 1645785 | * | 4/1991 | 454/284 |
| WO | 94/10872 | | 5/1994 | |

* cited by examiner

*Primary Examiner*—Harold Joyce
(74) *Attorney, Agent, or Firm*—Katten Muchin Zavis Rosenman

(57) ABSTRACT

Based on a hollow column (1), terminating at the bottom in a baseplate (2) and at the top in a core (3) from which vanes (4–4'), also hollow and connected with the column (1), emerge; a motor-fan (6–7) is installed in the baseplate (2), activated by means of a circuit breaker (8), which absorbs air from the outside through the lower and open end of the baseplate (2), and delivers it to the vanes (4–4') from which it passes to the outside through opposite nozzles (5), so that this flow of air causes a rotary movement of the vanes (4–4'), by reaction, and said vanes, in their rotation, form a curtain against solar radiation, while simultaneously moving air below them. The wall of the column (1) can be translucent to allow the light generated by an internal spotlight to pass through it and within said column an electrical resistance or other means of heating that allows the ventilator to provide hot air, can be installed; the external surface of said column forming furthermore an advertising panel.

5 Claims, 2 Drawing Sheets

VERTICAL VENTILATOR FOR OUTDOORS AND/OR INDOORS

OBJECT OF THE INVENTION

This invention refers to a vertical ventilator, that is, to a device able to provide a flow of air perpendicularly to the ground, equally usable outdoors and indoors; and that in outdoor use it simultaneously acts as provider of shade, so that this combined action, shade/airflow, signifies optimum environmental conditions for people that are beneath it.

Additionally and especially when used indoors, it can supply a flow of hot air, when necessary, with the same object of improving the environmental conditions beneath it.

BACKGROUND OF THE INVENTION

Compared with conventional parasols, made up of a shaft of appropriate height, with a supporting baseplate, the shaft terminating on top in a parasol, strictly speaking. Parasols capable of generating a ventilation effect are also known, as, for example, the one that is described in the European patent EP0668733, in which a conventional parasol incorporates a fan in the upper end of its shaft that creates a flow of air projected downwards, that is towards the area covered by the parasol.

DESCRIPTION OF THE INVENTION

The ventilator proposed by the invention is based on a totally different and novel structural concept; specifically in the fact that the parasol, strictly speaking, in comparison with the static and usually textile nature of conventional parasols, consists of a number of vanes, conveniently connected to a rotary core mounted with freedom to rotate on a column, so that said vanes, when rotating, constitute a sort of circular "curtain" that acts as a parasol on forming a barrier to the solar radiation.

For moving said vanes a motor installed in the supporting column that can act directly on the core that joins them; however preferably the motor will be placed in the baseplate or base of the column, and it will activate a fan, so that this latter, taking air from outside, will drive it in an upward direction along the column until reaching the upper core, from which it will radially pass to the vanes, which will be fitted with nozzles in their edges, as outlets for the air, so that, by a reaction effect, the jets of air at their exit from the vanes will cause the rotation of said vanes, and likewise a removal of the ambient air that surrounds the ventilator assembly.

An electrical circuit breaker, conveniently positioned, will, in any case, allow the operation of said motor, which can be remote from the aero-parasol, the same as the supplementary fan, so that a single motor-fan assembly, through appropriate ducts, can drive a set of vertical ventilators, with greater efficiency.

The same electrical circuit breaker, but preferably another placed beside the first, allows a closing of the supply circuit to the luminous internal spotlight, in which case the ventilator shaft must be of a translucent material.

In accordance with another of the characteristics of the invention, the possibility that within the ventilator shaft, and above the actual ventilator, a heating element, such as an electrical resistance for example, be placed, has also been envisaged; so that the ventilator is able to generate hot air, in which case another circuit breaker supplementing the previously mentioned ones, will be necessary.

It has also been envisaged that the vanes could be removable, for those cases in which, for example, space is limited; to this effect it being envisaged that the air-outlet nozzles, which can be located in any part of the vane, can also be placed in the actual shaft or in the core of the ventilator.

Furthermore, said nozzles can also be directional, so that, depending on their orientation, the vanes move or don't move, and in the case that they move, they can do so at different speeds; it being possible, however, for the ventilator to be fitted with an interlocking device, of any conventional type, that assures the immobility of said vanes, these latter which can also be directional.

Finally, the central shaft or column of the ventilator will be able to carry on its surface any type of advertising message that helps with paying for it and/or its maintenance.

DESCRIPTION OF THE DRAWINGS

To supplement this description being given and with the aim of leading to a better understanding of the characteristics of the invention, in accordance with a preferred example of its practical embodiment, as an integral part of this description it is accompanied by a set of drawings where in an illustrative and non-limiting way, the following have been represented.

PREFERABLE EMBODIMENT OF THE INVENTION

Figure 1:
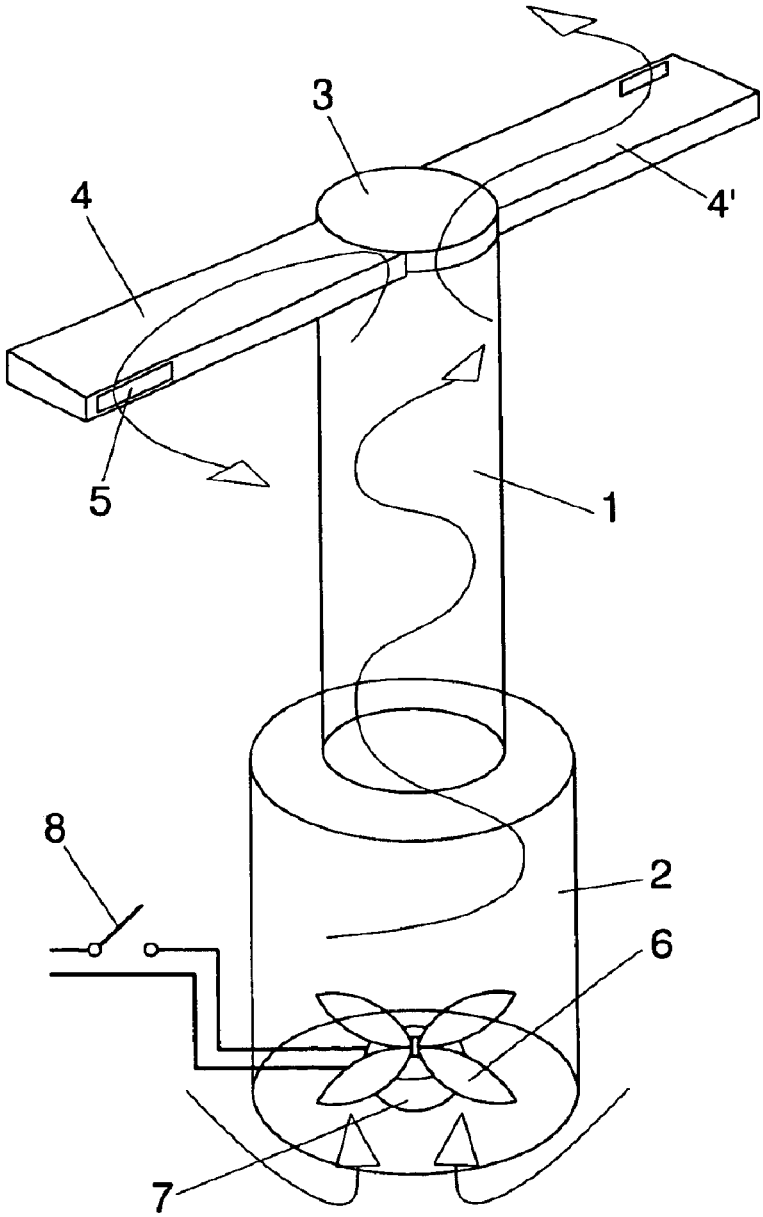
FIG. 1.—Shows a perspective schematic representation of a vertical ventilator carried out in agreement with the object of this invention.

In view of the drawings presented, especially FIG. 1, it can be seen how the vertical ventilator that the invention proposes is structured based on a column (1) of appropriate length, hollow, that expands into a base or baseplate (2) at its lower end, that gives it adequate stability, while at its upper end it expands into the core (3) of a pair of vanes (4–4') that, together with said core (3), are mounted with freedom to rotate on the column (1) and are hollow, opening internal connection with this latter, the vanes (4–4') incorporating in opposite edges and near their free end, twin nozzles (5), through which the air passes to the outside (in accordance with the arrows shown in FIG. 1) for operation of the vanes (4–4'), air generated by a fan (6), set up in the base or pedestal (2) and driven by an electric motor (7) in whose supply circuit a circuit breaker (8) is installed that allows its stopping or starting, as the user wishes; so that said ventilator (6), as also has been shown with arrows in the aforementioned FIG. 1, draws air through the lower open base of the baseplate (2), from the outside, the air ascends through the interior hollow of the column (1), forks in the core (3) to the vanes (4) and it passes again to the outside through the nozzles (5) of these latter, causing their rotation.

Figure 2:
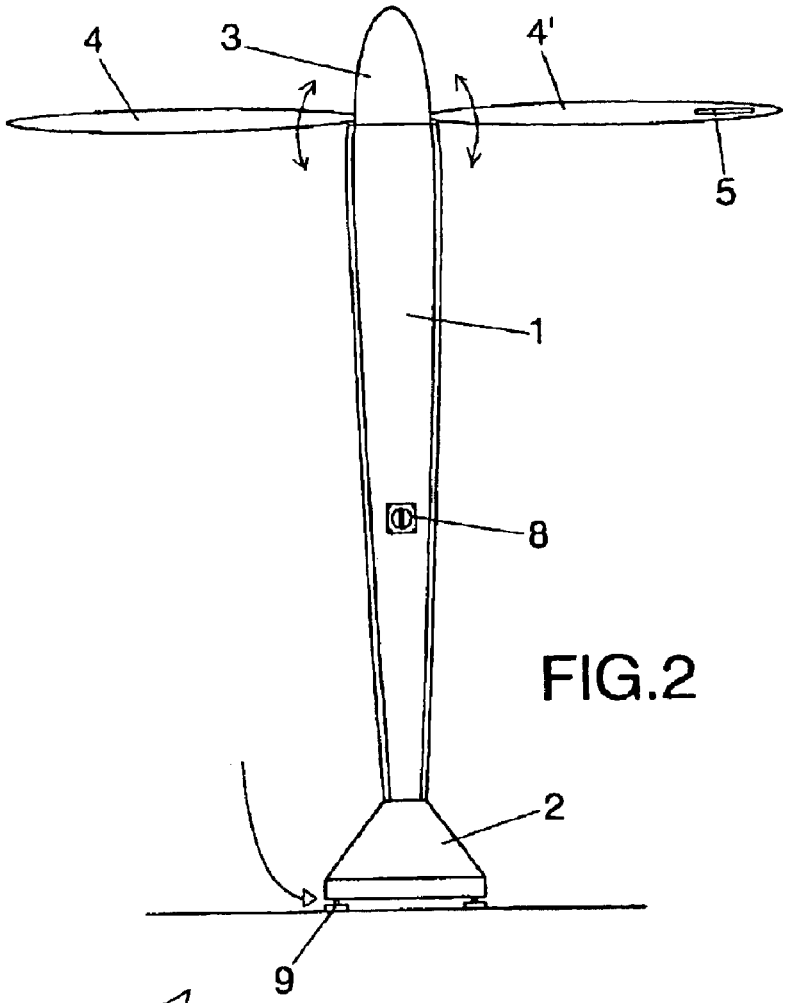
FIG. 2.—Shows a side elevation view of a specific practical embodiment for this vertical ventilator.
Figure 3:
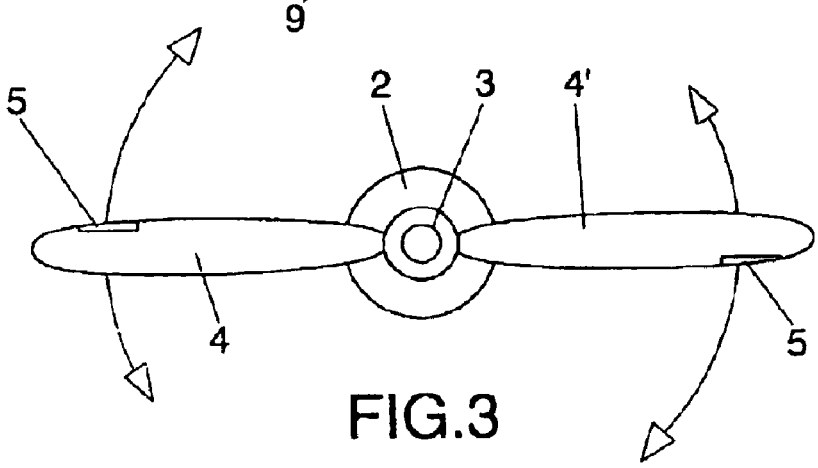
FIG. 3.—Shows, finally, a plan view of the vertical ventilator of FIG. 2.

In FIGS. 2 and 3 a more aerodynamic configuration for the vanes and for the rest of the parts making up the device has been shown, with a baseplate (2) considerably smaller and fitted with adjustable legs (9), in this case the circuit breaker (8) being placed on the actual column (1), and at a suitable height level for its easy operation.

Nevertheless and has been said previously, the solutions shown in the drawings are mere examples of practical embodiment of the invention, which allows other alternatives, among them the substitution of the motor-fan (6–7) by a motor housed in the upper area of the column (1) and that acts directly on the vanes (4–4'), so that these move by the direct action of this motor, instead of moving due to the reaction of the air that passes from them through their nozzles (5), in this case it being evident that the vanes (4–4') must have a definite "helix" type inclination, so that it is they themselves, with their movement, that create a flow of vertical air that improves the ambient conditions beneath the vertical ventilator.

Similarly the column (1) can be translucent to allow the light generated by an internal luminous spotlight, not shown in the drawing, to pass through it; in the same way that within said column (1), preferably above the fan (6), an electrical resistance, or another means of heating, can be installed, when instead fresh air, hot air is required, to which effect the circuit breaker (8) will be substituted by a button pad or a set of circuit breakers that allow the individual control of the previously mentioned electrical functions.

The nozzles (5) can be located at any position on the vanes (4–4'), or even be directional (see the bi-directional arrows on the vanes (4–4') adjacent the core (3) in FIG. 2), so that on one hand they send the air towards any required area, and on the other hand they may act or not act as propellers for the vanes (4), which can even be removable, specifically when the availability of space makes this advisable, to which effect there could also be nozzles (5), both in the actual column (1) and in the core (3), and also having any layout or orientation that is considered opportune.

As is evident from the observation of either of the FIGS. 1 and 2, both the column (1) and the lower baseplate (2), offer suitable extensive surfaces for the placing on them of any type of advertising message that helps in paying for and/or maintenance of the ventilator.

What is claimed is:

1. A vertical ventilator for outdoors and/or indoors that provides protection against solar radiation and simultaneously acts as a ventilator removing air in its vicinity comprising:

a stabilizing base;

a supporting column positioned on said stabilizing base;

a pair of vanes welded to an intermediate core that is rotatably mounted on an upper end of said supporting column;

wherein rotary movement of said vanes provides both protection against the effects of solar radiation and movement and ventilation of the air beneath said vanes; and wherein the supporting column and vanes are hollow; said supporting column incorporating in the stabilizing base a motor-fan activated through a circuit breaker that creates an upwards flow of said air inside the supporting column, which said air passes to the outside through nozzles formed in opposite end edges of said vanes.

2. A vertical ventilator according to claim 1, wherein the supporting column is translucent to allow light generated by an internal luminous spotlight, activated by means of said breaker, to pass therethrough.

3. A vertical ventilator according to claim 1, wherein the column is capable of housing an electrical resistance, or heating element, within it, to raise the temperature of said air that passes to through it, which resistance is activated by said circuit breaker.

4. A vertical ventilator for outdoors and/or indoors that provides protection against solar radiation and simultaneously acts as a ventilator removing air in its vicinity comprising:

a stabilizing base;

a supporting column positioned on said stabilizing base;

a pair of vanes welded to an intermediate core that is rotatably mounted on an upper end of said supporting column;

nozzles formed in opposite end edges of said vanes, said nozzles for air to pass to pass through;

wherein rotary movement of said vanes provides both protection against the effects of solar radiation and movement and ventilation of the air beneath said vanes; and wherein said nozzles are variably positioned on the vanes for use of the ventilator in rooms with reduced dimensions.

5. A vertical ventilator for outdoors and/or indoors that provides protection against solar radiation and simultaneously acts as a ventilator removing air in its vicinity comprising:

a stabilizing base;

a supporting column positioned on said stabilizing base;

a pair of vanes welded to an intermediate core that is rotatably mounted on an upper end of said supporting column;

nozzle formed in opposite end edges of said vanes, said nozzles for air to pass to pass through;

wherein rotary movement of said vanes provides both protection against the effects of solar radiation and movement and ventilation of the air beneath said vanes;

wherein said nozzles are directional, giving a variable orientation in the jets of air from said nozzles.

* * * * *